US009900947B2

(12) United States Patent
Li et al.

(10) Patent No.: US 9,900,947 B2
(45) Date of Patent: Feb. 20, 2018

(54) BACKLIGHT, REGULATION METHOD THEREOF, REGULATION DEVICE AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Jialong Li, Beijing (CN); Hao Zhang, Beijing (CN); Lingyun Shi, Beijing (CN); Xue Dong, Beijing (CN); Di Wang, Beijing (CN); Wei Wang, Beijing (CN); Qingfang Bian, Beijing (CN); Shuai Han, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/109,472

(22) PCT Filed: Jan. 5, 2016

(86) PCT No.: PCT/CN2016/070094

§ 371 (c)(1),
(2) Date: Jul. 1, 2016

(87) PCT Pub. No.: WO2017/028480

PCT Pub. Date: Feb. 23, 2017

(65) Prior Publication Data

US 2017/0231046 A1 Aug. 10, 2017

(30) Foreign Application Priority Data

Aug. 19, 2015 (CN) ..... 2015 1 0511729

(51) Int. Cl.
*H05B 37/02* (2006.01)
*H05B 33/08* (2006.01)

(52) U.S. Cl.
CPC ..... *H05B 33/0845* (2013.01); *H05B 33/0827* (2013.01)

(58) Field of Classification Search
CPC ..... H05B 33/0845; H05B 33/0827
(Continued)

(56) References Cited

U.S. PATENT DOCUMENTS

2006/0103612 A1 5/2006 Ozaki
2012/0081407 A1* 4/2012 Chiou ..... G09G 3/3406 345/690

(Continued)

FOREIGN PATENT DOCUMENTS

AU 2014279337 A1 5/2014
CN 1701448 A 11/2005

(Continued)

OTHER PUBLICATIONS

Office Action dated Feb. 28, 2017 issued in corresponding Chinese Application No. 201510511729.X.

(Continued)

*Primary Examiner* — Don Le
(74) *Attorney, Agent, or Firm* — Nath, Goldberg & Meyer; Joshua B. Goldberg

(57) ABSTRACT

The present invention discloses a backlight, a regulation method thereof, a regulation device and a display device. The backlight comprises a driving unit, a register, a PWM unit and a light-emitting unit, the PWM unit is connected between the driving unit and the light-emitting unit, and the register is connected to the PWM unit. The driving unit is used for converting a voltage signal to a primary driving signal; the register is used for defining a preset threshold value, which is the maximum value of duty ratio of a signal that the PWM unit outputs when performing a PWM process; the PWM unit is used for regulating duty ratio of the (Continued)

primary driving signal according to the preset threshold value and generating a regulated driving signal; and the light-emitting unit is used for emitting light when being driven by the regulated driving signal.

13 Claims, 4 Drawing Sheets

(58) Field of Classification Search
USPC ..... 315/210
See application file for complete search history.

(56) References Cited

U.S. PATENT DOCUMENTS

| | | | | |
|---|---|---|---|---|
| 2014/0139499 | A1* | 5/2014 | Hussain | H05B 33/0827 345/204 |
| 2016/0133202 | A1 | 5/2016 | Saito et al. | |

FOREIGN PATENT DOCUMENTS

| | | | |
|---|---|---|---|
| CN | 101137262 | A | 3/2008 |
| CN | 101266345 | A | 9/2008 |
| CN | 101656049 | A | 2/2010 |
| CN | 101800027 | A | 8/2010 |
| CN | 102467861 | A | 5/2012 |
| CN | 103369765 | A | 10/2013 |
| CN | 104681007 | A | 6/2015 |
| CN | 104715736 | A | 6/2015 |
| CN | 105096843 | A | 11/2015 |
| EP | 1 564 821 | A1 | 8/2005 |
| EP | 3 010 009 | A1 | 4/2016 |
| JP | 2010205530 | A | 9/2010 |
| WO | 2014/199841 | A1 | 12/2014 |
| WO | 2014199841 | A1 | 12/2014 |

OTHER PUBLICATIONS

International Search Report dated Apr. 29, 2016 corresponding to International application No. PCT/CN2016/070094.

Written Opinion of the International Searching Authority dated Apr. 29, 2016 corresponding to International application No. PCT/CN2016/070094.

Office Action dated Sep. 18, 2017 issued in corresponding Chinese Application No. 201510511729.X.

* cited by examiner

BACKLIGHT, REGULATION METHOD THEREOF, REGULATION DEVICE AND DISPLAY DEVICE

This is a National Phase Application filed under 35 U.S.C. 371 as a national stage of PCT/CN2016/070094, filed Jan. 5, 2016, an application claiming the benefit of Chinese Application No. 201510511729.X, filed on Aug. 19, 2015, the content of each of which is hereby incorporated by reference in its entirety.

TECHNICAL FIELD

The present invention relates to the field of display technology, and particularly relates to a backlight, a regulation method thereof, a regulation device and a display device.

BACKGROUND

In a display device, since a liquid crystal display panel itself cannot emit light, a backlight is needed to provide uniformly distributed light having sufficient brightness for the liquid crystal display panel so that the liquid crystal display panel can work normally.

FIG. 1 is a schematic structural diagram of a backlight in the prior art, as shown in FIG. 1, the backlight includes a driving unit and a light-emitting unit connected to the driving unit, the driving unit is used for converting a voltage signal into a driving signal (a current signal) for driving the light-emitting unit, and the light-emitting unit emits light having a certain brightness when driven by the driving signal.

However, in a practical manufacturing process of backlights, due to factors such as a process error and the like, actual properties of driving units and/or light-emitting units of some of backlights in a same batch may significantly differ from ideal properties thereof. Specifically, when a same voltage signal is applied to the backlights in the same batch, some backlights may have brightnesses distinctly different from those of the others.

For backlights in a same batch, all backlights correspond to a same maximum brightness voltage signal when reaching their respective maximum brightnesses. When the maximum brightness voltage signal is applied to the backlights in this batch, the maximum brightnesses of some backlights may not fall within a preset brightness range. For example, it is assumed that the maximum brightnesses of the manufactured backlights should be in the range of 400 nits to 500 nits as required by a customer (i.e., the backlights should have luminous brightnesses between 400 nits and 500 nits when being applied with the maximum brightness voltage signal), but, among the backlights in the same batch, some have luminous brightnesses smaller than 400 nits or larger than 500 nits when being applied with the maximum brightness voltage signal. For a backlight having a luminous brightness smaller than 400 nits, it will not be applied to a display device as it fails to meet the requirements of the customer, whereas for a backlight having a luminous brightness larger than 500 nits (i.e., a high brightness backlight), it will be applied to a display device as its maximum luminous brightness meets the requirements of the customer, i.e., its luminous brightness range can meet the requirements of the customer.

However, because the backlights whose maximum luminous brightnesses are larger than that required by the customer are applied to a display device, the display device has a poor uniformity of luminous brightness range; further, the display device including the high brightness backlight has relatively large power consumption because of excessively high brightness.

SUMMARY

The present invention provides a backlight, a regulation method thereof, a regulation device and a display device, which can effectively improve uniformity of luminous brightness ranges of backlights in a production line.

According to one aspect of the present invention, there is provided a backlight, including a driving unit, a register, a pulse width modulation (PWM) unit and a light-emitting unit, the PWM unit being connected between the driving unit and the light-emitting unit, and the register being connected to the PWM unit, wherein the driving unit is used for converting a voltage signal to a primary driving signal;

the register is used for defining a preset threshold value, preset threshold value being the maximum value of duty ratio of a signal that the PWM unit outputs when performing a PWM process;

the PWM unit is used for regulating duty ratio of the primary driving signal according to the preset threshold value and generating a regulated driving signal; and the light-emitting unit is used for emitting light when being driven by the regulated driving signal.

Optionally, the light-emitting unit includes a plurality of LEDs connected in parallel.

Optionally, the PWM unit is used for regulating the duty ratio of the primary driving signal to be equal to the preset threshold value according to the preset threshold value defined by the register.

According to another aspect of the present invention, there is provided a regulation method of the above backlight, including steps of:

inputting a maximum brightness voltage signal to the driving unit to enable the driving unit to output a primary maximum brightness driving signal, wherein the maximum brightness voltage signal is a voltage signal to which the backlight corresponds when exhibiting its maximum brightness;

determining whether a first actual maximum luminous brightness that the light-emitting unit exhibits upon receipt of the primary maximum brightness driving signal is within a preset brightness range or not; and setting the preset threshold value according to the first actual maximum luminous brightness and the preset brightness range such that a second actual maximum luminous brightness that the light-emitting unit exhibits upon receipt of a regulated maximum brightness driving signal whose duty ratio is equal to the preset threshold value is within the preset brightness range when it is determined that the first actual maximum luminous brightness is larger than a maximum value in the preset brightness range.

Optionally, the second actual maximum luminous brightness that the light-emitting unit exhibits upon receipt of the regulated maximum brightness driving signal whose duty ratio is equal to the preset threshold value is equal to an average value of a minimum value and the maximum value in the preset brightness range.

Optionally, the regulation method further comprises a step of setting the preset threshold value to 100% when it is determined that the first actual maximum luminous brightness is within the preset brightness range.

According to still another aspect of the present invention, there is provided a regulation device for the above backlight, including a voltage input unit, a determination unit and a threshold value setting unit, wherein the voltage input unit is used for inputting a maximum brightness voltage signal to the driving unit to enable the driving unit to output a primary maximum brightness driving signal, wherein the maximum brightness voltage signal is a voltage signal to which the backlight corresponds when exhibiting its maximum brightness;

the determination unit is used for determining whether a first actual maximum luminous brightness that the light-emitting unit exhibits upon receipt of the primary maximum brightness driving signal is within a preset brightness range or not; and the threshold value setting unit is used for setting a preset threshold value in the register according to the first actual maximum luminous brightness and the preset brightness range such that a second actual maximum luminous brightness that the light-emitting unit exhibits upon receipt of a regulated maximum brightness driving signal whose duty ratio is equal to the preset threshold value is within the preset brightness range when it is determined by the determination unit that the first actual maximum luminous brightness is larger than a maximum value in the preset brightness range.

Optionally, the threshold value setting unit is further used for setting the preset threshold value to 100% when it is determined by the determination unit that the first actual maximum luminous brightness is within the preset brightness range.

According to another aspect of the present invention, there is provided a display device, including a backlight, which is the above backlight.

The present invention has the beneficial effects as follows.

The present invention provides a backlight, a regulation method thereof, a regulation device and a display device, and the backlight includes a driving unit, a register, a PWM unit and a light-emitting unit, the PWM unit being connected between the driving unit and the light-emitting unit, and the register being connected to the PWM unit; the driving unit is used for converting a voltage signal to a primary driving signal; the register is used for defining a preset threshold value, which is the maximum value of duty ratio of a signal that the PWM unit outputs when performing a PWM process; the PWM unit is used for regulating duty ratio of the primary driving signal according to the preset threshold value and generating a regulated driving signal; and the light-emitting unit is used for emitting light when being driven by the regulated driving signal. The backlight provided by the present invention can limit its maximum luminous brightness, so as to regulate its actual luminous brightness range. Therefore, when a high brightness backlight exists in a production line, the maximum luminous brightness of the high brightness backlight in the production line can be lowered by using the technical solution of the present invention, so that uniformity of luminous brightness ranges of the backlights in the production line can be effectively improved. In addition, as the maximum luminous brightness of the high brightness backlight is lowered, the display device including the high brightness backlight has reduced overall power consumption.

DETAILED DESCRIPTION

In order that those skilled in the art can better understand the technical solutions of the present invention, a backlight, a regulation method thereof, a regulation device and a display device provided by the present invention will be described in detail below in conjunction with the accompanying drawings.

Figure 1:
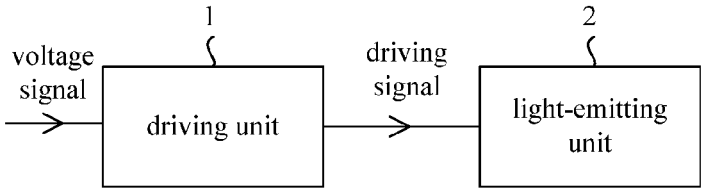
FIG. 1 is a schematic structural diagram of a backlight in the prior art.
Figure 2:
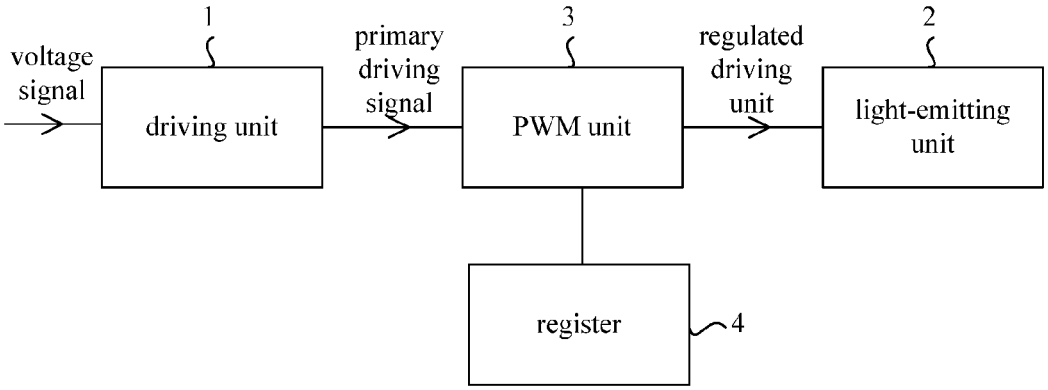
FIG. 2 is a schematic structural diagram of a backlight provided by an embodiment of the present invention.

According to one aspect of the present invention, there is provided a backlight, and FIG. 2 is a schematic structural diagram of a backlight provided by an embodiment of the present invention. As shown in FIG. 2, the backlight includes a driving unit 1, a register 4, a pulse width modulation (PWM) unit 3 and a light-emitting unit 2, the PWM unit 3 is connected between the driving unit 1 and the light-emitting unit 2, and the register 4 is connected to the PWM unit 3; the driving unit 1 is used for converting a voltage signal to a primary driving signal; the register 4 is used for defining a preset threshold value, which is the maximum value of duty ratio of a signal that the PWM unit 3 outputs when performing a PWM process; the PWM unit 3 is used for regulating duty ratio of the primary driving signal according to the preset threshold value defined in the register 4 and generating a regulated driving signal; and the light-emitting unit 2 is used for emitting light when being driven by the regulated driving signal.

In the embodiment, the light-emitting unit 2 may be any light-emitting structure that can be current-driven, such as an OLED, an LED, or the like. In the embodiment, optionally, the light-emitting unit 2 includes a plurality of LEDs connected in parallel.

In the technical solution of the present invention, by providing the PWM unit 3 between the driving unit 1 and the light-emitting unit 2 and defining, by the register 4, a maximum value of duty ratio of a signal that the PWM unit 3 outputs when performing a PWM process, the actual maximum luminous brightness of the backlight can be limited, that is, the actual luminous brightness range of the backlight can be regulated.

The inventive principle of the present invention will be described in detail below by way of examples. It is assumed that the maximum luminous brightness of a manufactured backlight should be between 400 nits and 500 nits as required by a customer, that is, the customer requires that the luminous brightness of the backlight applied with the maximum brightness voltage signal should be between 400 nits and 500 nits. It is assumed that, in the case where the PWM unit 3 does not perform a PWM process on the driving signal generated by the driving unit 1, the light-emitting unit 2 emits light having a brightness of 550 nits after the backlight of the present embodiment is applied with the maximum brightness voltage signal, that is, the maximum luminous brightness of the backlight provided by the embodiment is larger than the maximum luminous brightness required by the customer, and the theoretical luminous brightness of this backlight is in the range of 0 to 550 nits.

In the embodiment, in order to allow the maximum luminous brightness of the light-emitting unit 2 to be between 400 nits and 500 nits, the PWM unit needs to regulate duty ratio of a primary maximum brightness driving signal (its duty ratio is 100%) that the driving unit 1 outputs upon receipt of the maximum brightness voltage signal. For example, when an operator wants to regulate the maximum luminous brightness of the light-emitting unit 2 to be 440 nits, the maximum value of the duty ratio of the signal that the PWM unit 3 outputs while performing a PWM process is limited to 80% by using the register 4, that is, the preset threshold value is set to 80%.

In this case, the maximum duty ratio of the signal that can be outputted by the PWM unit 3 is 80%, and the maximum luminous brightness of the light-emitting unit 2 is 440 nits.

Thereinafter, the principle of regulating the maximum brightness value of the backlight using the PWM unit 3 in the embodiment will be described in detail in conjunction with the accompanying drawings.

Figure 3:
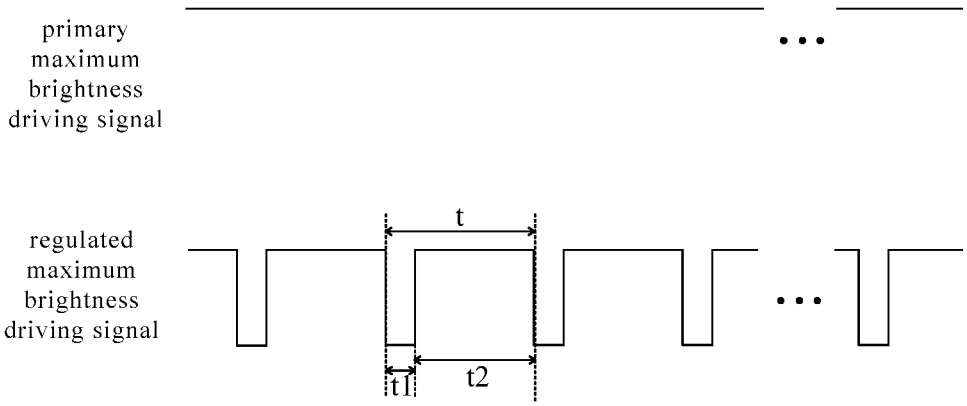
FIG. 3 is a schematic diagram illustrating waveforms of a primary maximum brightness driving signal and a regulated maximum bright driving signal whose duty ratio is 80%.

FIG. 3 is a schematic diagram illustrating waveforms of a primary maximum brightness driving signal and a regulated maximum brightness driving signal whose duty ratio is 80%, as shown in FIG. 3, when the light-emitting unit 2 receives a primary maximum brightness driving signal whose duty ratio is 100%, it will emit light continuously, and in this case the luminous brightness of the light-emitting unit 2 is 550 nits. However, when the light-emitting unit 2 receives a regulated maximum brightness driving signal whose duty ratio is 80% (that is, in one period t, a ratio of time t2 in which the signal is at a high level to the period t is 0.8), it will continuously switch between "light-emitting state" (time period corresponding to t2) and "non-light-emitting state" (time period corresponding to t1), and the switching frequency is the same as the frequency of the regulated maximum brightness driving signal. It should be noted that because the frequency at which the light-emitting unit 2 switches between the "light-emitting state" and the "non-light-emitting state" is high, human eyes cannot perceive this switching process. Taking a case where the period t is 1 second as an example, the total of time in which the light-emitting unit 2 is in the "light-emitting state" is 0.8 seconds, the total of time in which the light-emitting unit 2 is in the "non-light-emitting state" is 0.2 seconds, and in this case, the luminous brightness of the light-emitting unit 2 is 550 nits*0.8, i.e., 440 nits.

When the register 4 limits the maximum value of the duty ratio of the signal that the PWM unit 3 outputs while performing a PWM process to 80%, the maximum brightness that the light-emitting unit 2 can exhibit will not exceed 440 nits no matter how the PWM unit 3 regulates the primary maximum brightness driving signal, that is, the actual luminous brightness of the backlight is in the range of 0 to 440 nits. It should be noted that the above case where the preset threshold value is set to 80% is only exemplary, and those skilled in the art should know that the preset threshold value may be regulated according to the actual performance of the backlight and the customer's requirements in the present invention.

In addition, it should be supplemented that, when a user uses the backlight provided by the embodiment, the duty ratio of the primary driving signal may be regulated appropriately according to actual needs by using the PWM unit 3 (the duty ratio of the signal outputted by the PWM unit 3 is smaller than or equal to the preset threshold value), so as to change the luminous brightness of the backlight, thereby regulating the overall brightness of a display device.

Embodiments of the present invention also provide a display device including a backlight, wherein the backlight is the above-described backlight, and for specific description of the backlight, reference may be made to the above corresponding content and redundant description will not be given here.

The embodiments of the present invention provide a backlight and a display device, and the backlight can limit the maximum luminous brightness of itself, so that the actual luminous brightness range thereof can be regulated. Therefore, when high brightness backlights exist in a production line, the maximum luminous brightnesses of the high brightness backlights in the production line can be lowered by using the technical solution of the present invention, so that uniformity of luminous brightness ranges of the backlights in the production line can be effectively improved. In addition, as the maximum luminous brightness of the high brightness backlight is lowered, the display device including the high brightness backlight has reduced overall power consumption.

Figure 4:
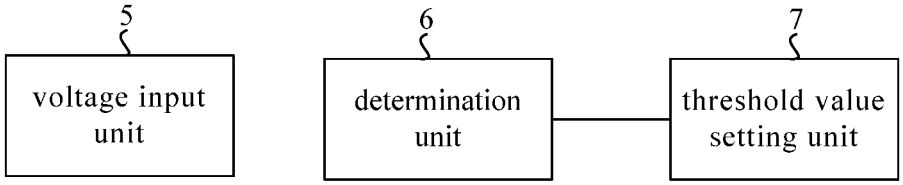
FIG. 4 is a schematic structural diagram of a regulation device for a backlight provided by an embodiment of the present invention.
Figure 5:
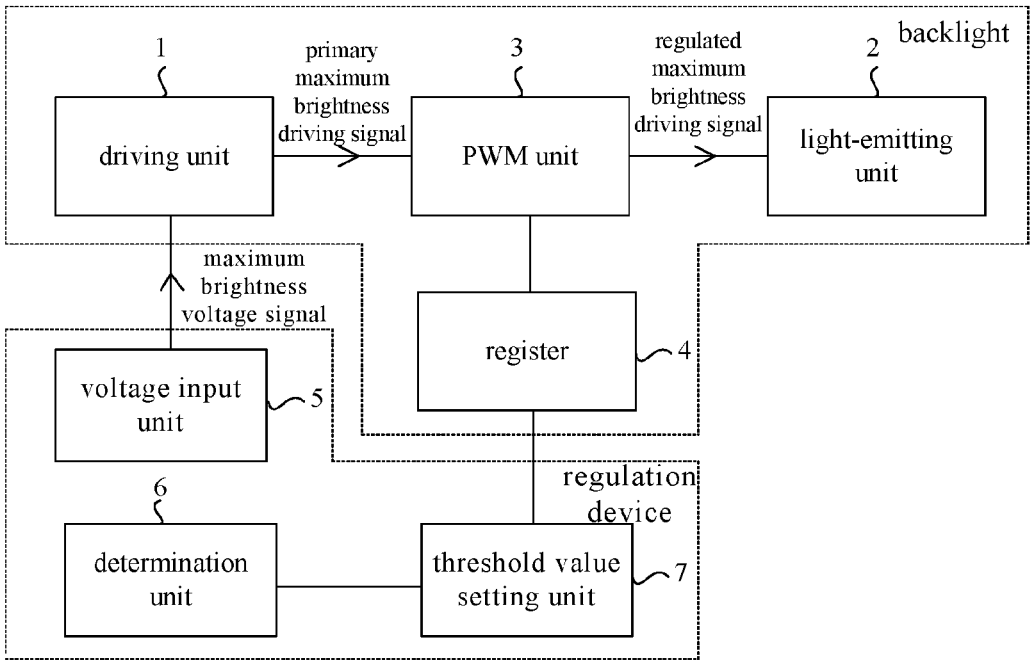
FIG. 5 is a schematic diagram of regulating the backlight shown in FIG. 2 by using the regulation device shown in FIG. 4.

According to another aspect of the present invention, there is provided a regulation device for a backlight, FIG. 4 is a schematic structural diagram of a regulation device for a backlight provided by an embodiment of the present invention, and FIG. 5 is a schematic diagram of regulating the backlight shown in FIG. 2 by using the regulation device shown in FIG. 4. As shown in FIGS. 4 and 5, the backlight is the backlight in the above embodiment, and the regulation device for the backlight includes a voltage input unit 5, a determination unit 6 and a threshold value setting unit 7.

The voltage input unit 5 is used for inputting a maximum brightness voltage signal to the driving unit 1, so as to enable the driving unit 1 to output a primary maximum brightness driving signal, wherein the maximum brightness voltage signal is a voltage signal to which the backlight corresponds when exhibiting its maximum brightness. In the case that the maximum brightness voltage signal is applied to the driving unit 1 in the backlight by using the voltage input unit 5, the driving unit 1 will output a primary maximum brightness driving signal, and if the primary maximum brightness driving signal is directly inputted to the light-emitting unit 2 without going through the PWM process, the light-emitting unit 2 will exhibit a first actual maximum luminous brightness.

The determination unit 6 is used for determining whether the first actual maximum luminous brightness that the light-emitting unit 2 exhibits upon receipt of the primary maximum brightness driving signal is within a preset brightness range or not. The preset brightness range is set according to the maximum luminous brightness required by the user.

The maximum luminous brightness of the light-emitting unit 2 may be detected in any way known in the art. For example, a photosensor may be used to acquire a brightness signal of the light-emitting unit 2 such as the first actual maximum luminous brightness, and convert the acquired brightness signal to a corresponding electrical signal, which is outputted to the determination unit 6. The determination unit 6 determines based on the received electrical signal corresponding to the brightness signal.

If the determination unit 6 determines that the first actual maximum luminous brightness that the light-emitting unit 2 exhibits upon receipt of the primary maximum brightness driving signal is smaller than the minimum value of the preset brightness range, it indicates that this backlight fails to meet the level required by the customer, that is, this backlight cannot be applied in a display device.

If the determination unit 6 determines that the first actual maximum luminous brightness that the light-emitting unit 2 exhibits upon receipt of the primary maximum brightness driving signal is larger than the maximum value of the preset brightness range, it indicates that this backlight exceeds the level required by the consumer, but in consideration of both uniformity of luminous brightness ranges of backlights in a production line and overall power consumption of a display device, the maximum luminous brightness of the high brightness backlight needs to be limited. Specifically, the threshold value setting unit 7 sets a preset threshold value according to the first actual maximum luminous brightness of the backlight and the preset brightness range such that a second actual maximum luminous brightness that the light-emitting unit 2 exhibits upon receipt of a regulated maximum brightness driving signal whose duty ratio is equal to the preset threshold value is within the preset brightness range.

The preset threshold value may be determined according to the first actual maximum luminous brightness of the backlight and the second actual maximum luminous brightness desired by an operator, and the second actual maximum luminous brightness is within the preset brightness range. Optionally, the preset threshold value may be set such that the second actual maximum luminous brightness that the light-emitting unit 2 exhibits upon receipt of the regulated maximum brightness driving signal whose duty ratio is equal to the preset threshold value is equal to the average value of the minimum value and the maximum value in the preset brightness range; optionally, the preset threshold value may be set such that the second actual maximum luminous brightness that the light-emitting unit 2 exhibits upon receipt of the regulated maximum brightness driving signal whose duty ratio is equal to the preset threshold value is equal to the maximum value in the preset brightness range. Needless to say, any value in the preset brightness range may be chosen as the second actual maximum luminous brightness of the backlight, and a ratio of the second actual maximum luminous brightness to the first actual maximum luminous brightness is set as the preset threshold value.

In the embodiment, the preset threshold value in the register 4 is set by the threshold value setting unit 7 to limit the maximum duty ratio of the output signal from the PWM unit 3, so that the actual luminous brightness range of the backlight is regulated, and for the principle thereof, reference may be made to the corresponding content in the above embodiment, and redundant description will not be given here.

If the determination unit 6 determines that the first actual maximum luminous brightness that the light-emitting unit 2 exhibits upon receipt of the primary maximum brightness driving signal is within the preset brightness range, it indicates that this backlight meets the level required by the customer, in this case, there is no need to limit the maximum luminous brightness of the backlight, and therefore, the threshold value setting unit 7 may set the preset threshold value in the register 4 to 100%.

The embodiments of the present invention provide a regulation device for a backlight, the maximum luminous brightness of the backlight in the above embodiments can be limited accordingly by using the regulation device, so that the actual luminous brightness range of the backlight can be regulated. Therefore, when a high brightness backlight exists in a production line, the maximum luminous brightness of the high brightness backlight in the production line can be lowered by using the technical solution of the present invention, so that uniformity of luminous brightness ranges of the backlights in the production line can be effectively improved.

Figure 6:
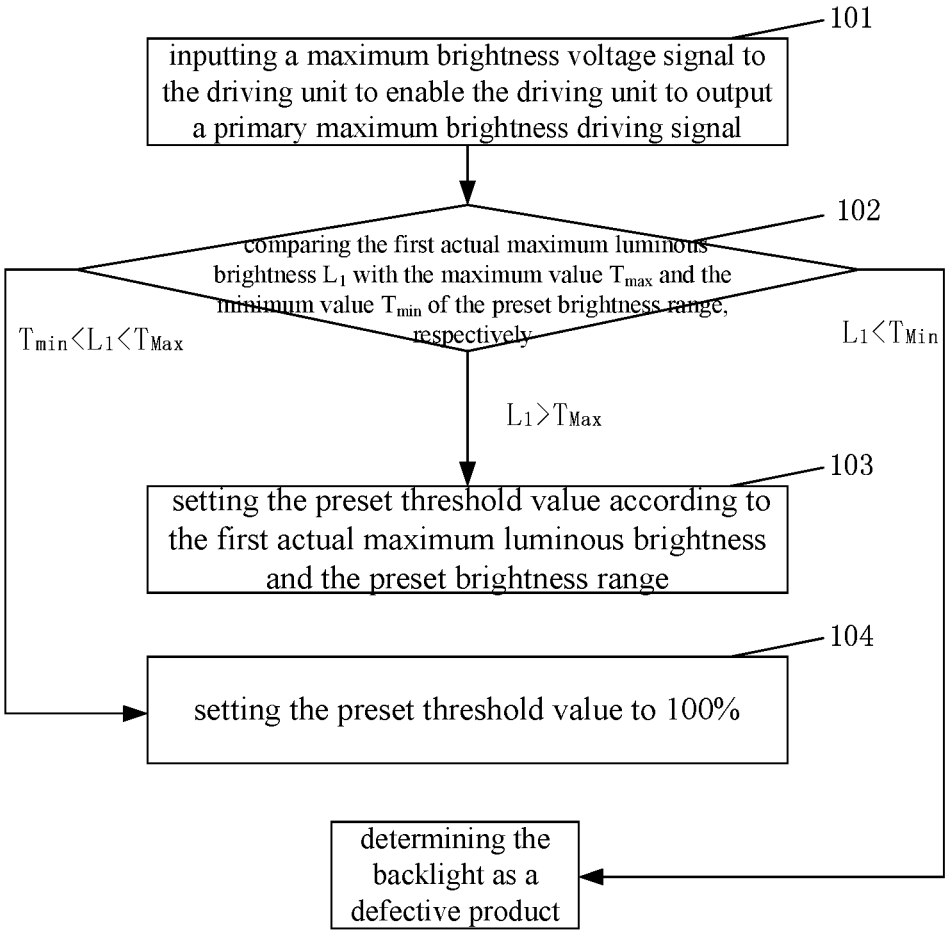
FIG. 6 is a flow chart of a regulation method of a backlight provided by an embodiment of the present invention.

According to another aspect of the present invention, there is provided a regulation method of a backlight. FIG. 6 is a flow chart of a regulation method of a backlight provided by an embodiment of the present invention. As shown in FIG. 6, the regulation method is based on the regulation device in the above embodiment and used to regulate the backlight provided by the above embodiment, and the regulation method includes steps as follows.

Step 101 includes: inputting a maximum brightness voltage signal to the driving unit 1 to enable the driving unit 1 to output a primary maximum brightness driving signal.

Step 101 is performed by the voltage input unit 5 provided in the above embodiment, and for the specific process, reference may be made to the corresponding description of the voltage input unit 5 in the above embodiment.

Step 102 includes: determining whether a first actual maximum luminous brightness that the light-emitting unit 2 exhibits upon receipt of the primary maximum brightness driving signal is within a preset brightness range or not. Step 102 is performed by the determination unit 6 provided in the above embodiment, and for the specific process, reference may be made to the corresponding description of the determination unit 6 in the above embodiment.

Specifically, the determination unit 6 compares the first actual maximum luminous brightness $L_1$ that the light-emitting unit 2 exhibits upon receipt of the primary maximum brightness driving signal with the maximum value $T_{max}$ and the minimum value $T_{min}$ of the preset brightness range, respectively. If the determination unit 6 determines that the first actual maximum luminous brightness $L_1$ that the light-emitting unit 2 exhibits upon receipt of the primary maximum brightness driving signal is smaller than the minimum value $T_{min}$ of the preset brightness range (i.e., $L_1<T_{min}$), it indicates that this backlight fails to meet the level required by the customer (i.e., the backlight is determined to be a defective product) and cannot be applied in a display device.

If the determination unit 6 determines that the first actual maximum luminous brightness $L_1$ that the light-emitting unit 2 exhibits upon receipt of the primary maximum brightness driving signal is larger than the maximum value $T_{max}$ of the preset brightness range (i.e., $L_1>T_{max}$), it indicates that this backlight exceeds the level required by the consumer, but in consideration of both uniformity of luminous brightness ranges of backlights in a production line and overall power consumption of a display device, the maximum luminous brightness of the high brightness backlight needs to be limited. In this case, it proceeds to the following step 103.

If the determination unit 6 determines that the first actual maximum luminous brightness $L_1$ that the light-emitting unit 2 exhibits upon receipt of the primary maximum brightness driving signal is within the preset brightness range (i.e., $T_{min}\leq L_1\leq T_{max}$), it indicates that the backlight meets the level required by the customer, and it proceeds to the following step 104.

Step 103 includes: setting the preset threshold value according to the first actual maximum luminous brightness and the preset brightness range such that a second actual maximum luminous brightness that the light-emitting unit 2 exhibits upon receipt of a regulated maximum brightness driving signal whose duty ratio is equal to the preset threshold value is within the preset brightness range.

Step 103 is performed by the threshold value setting unit 7 provided in the above embodiment, and for the specific process, reference may be made to the corresponding description of the threshold value setting unit 7 in the above embodiment.

Optionally, the threshold value setting unit 7 may set the preset threshold value such that the second actual maximum luminous brightness that the light-emitting unit 2 exhibits upon receipt of the regulated maximum brightness driving signal whose duty ratio is equal to the preset threshold value is equal to the average value of the minimum value and the maximum value in the preset brightness range, that is, the preset threshold value is set to be equal to a ratio of the second actual maximum luminous brightness to the average value of the minimum value and the maximum value in the preset brightness range. Step 104 includes: setting the preset threshold value in the register 4 to 100%.

Step 104 is also performed by the threshold value setting unit 7. Since it has been determined in step 102 that the backlight meets the level required by the customer, there is no need to limit the maximum luminous brightness of the backlight, and thus the threshold value setting unit 7 may set the preset threshold value in the register 4 to 100%.

The embodiment of the present invention provides a regulation method of a backlight, the maximum luminous brightness of the backlight provided by the above embodiment is limited using the regulation method, so that the actual luminous brightness range of the backlight is regulated. Therefore, when a high brightness backlight exists in a production line, the maximum luminous brightness of the high brightness backlight in the production line can be lowered by using the technical solution of the present invention, so that uniformity of luminous brightness ranges of the backlights in the production line can be effectively improved.

It could be understood that the above implementations are merely exemplary implementations adopted for describing the principle of the disclosure, but the disclosure is not limited thereto. For those of ordinary skill in the art, various variations and improvements may be made without departing from the spirit and essence of the disclosure, and these variations and improvements shall also be regarded as falling into the protection scope of the disclosure.

What is claimed is:

1. A backlight, comprising a driving unit, a register, a pulse width modulation unit and a light-emitting unit, the pulse width modulation unit being connected between the driving unit and the light-emitting unit, and the register being connected to the pulse width modulation unit, wherein, the driving unit is used for converting a voltage signal to a primary driving signal;

the register is used for defining a preset threshold value, the preset threshold value being the maximum value of duty ratio of a signal that the pulse width modulation unit outputs when performing a pulse width modulation process;

the pulse width modulation unit is used for regulating duty ratio of the primary driving signal only according to the preset threshold value defined by the register and generating a regulated driving signal; and the light-emitting unit is used for emitting light when being driven by the regulated driving signal.

2. The backlight according to claim 1, wherein the light-emitting unit comprises a plurality of LEDs connected in parallel.

3. The backlight according to claim 1, wherein the pulse width modulation unit is used for regulating the duty ratio of the primary driving signal to be equal to the preset threshold value according to the preset threshold value defined by the register.

4. The backlight according to claim 2, wherein the pulse width modulation unit is used for regulating the duty ratio of the primary driving signal to be equal to the preset threshold value according to the preset threshold value defined by the register.

5. A display device, comprising the backlight according to claim 1.

6. The display device according to claim 5, wherein the light-emitting unit comprises a plurality of LEDs connected in parallel.

7. The display device according to claim 5, wherein the pulse width modulation unit is used for regulating the duty ratio of the primary driving signal to be equal to the preset threshold value according to the preset threshold value defined by the register.

8. The display device according to claim 6, wherein the pulse width modulation unit is used for regulating the duty ratio of the primary driving signal to be equal to the preset threshold value according to the preset threshold value defined by the register.

9. A regulation method of a backlight, the backlight comprising a driving unit, a register, a pulse width modulation unit and a light-emitting unit, the pulse width modulation unit being connected between the driving unit and the light-emitting unit, and the register being connected to the pulse width modulation unit, wherein, the driving unit is used for converting a voltage signal to a primary driving signal;

the register is used for defining a preset threshold value, the preset threshold value being the maximum value of duty ratio of a signal that the pulse width modulation unit outputs when performing pulse width modulation process;

the pulse width modulation unit is used for regulating duty ratio of the primary driving signal according to the preset threshold value defined by the register and generating a regulated driving signal; and the light-emitting unit is used for emitting light when being driven by the regulated driving signal, and the regulation method comprises steps of:

inputting a maximum brightness voltage signal to the driving unit to enable the driving unit to output a primary maximum brightness driving signal, wherein the maximum brightness voltage signal is a voltage signal to which the backlight corresponds when exhibiting its maximum brightness;

determining whether a first actual maximum luminous brightness that the light-emitting unit exhibits upon receipt of the primary maximum brightness driving signal is within a preset brightness range or not; and setting the preset threshold value according to the first actual maximum luminous brightness and the preset brightness range such that a second actual maximum luminous brightness that the light-emitting unit exhibits upon receipt of a regulated maximum brightness driving signal whose duty ratio is equal to the preset threshold value is within the preset brightness range, when it is determined that the first actual maximum luminous brightness is larger than a maximum value in the preset brightness range.

10. The regulation method of the backlight according to claim 9, wherein the second actual maximum luminous brightness that the light-emitting unit exhibits upon receipt of the regulated maximum brightness driving signal whose duty ratio is equal to the preset threshold value is equal to an average value of a minimum value and the maximum value in the preset brightness range.

11. The regulation method of the backlight according to claim 9, further comprising a step of: setting the preset threshold value to 100% when it is determined that the first actual maximum luminous brightness is within the preset brightness range.

12. A regulation device for a backlight, the backlight comprising a driving unit, a register, a pulse width modulation unit and a light-emitting unit, the pulse width modulation unit being connected between the driving unit and the light-emitting unit, and the register being connected to the pulse width modulation unit, wherein, the driving unit is used for converting a voltage signal to a primary driving signal;

the register is used for defining a preset threshold value, the preset threshold value being the maximum value of duty ratio of a signal that the pulse width modulation unit outputs when performing a pulse width modulation process;

the pulse width modulation unit is used for regulating duty ratio of the primary driving signal according to the preset threshold value defined by the register and generating a regulated driving signal; and the light-emitting unit is used for emitting light when being driven by the regulated driving signal, and the regulation device comprises a voltage input unit, a determination unit and a threshold value setting unit, wherein, the voltage input unit is used for inputting a maximum brightness voltage signal to the driving unit to enable the driving unit to output a primary maximum brightness driving signal, wherein the maximum brightness voltage signal is a voltage signal to which the backlight corresponds when exhibiting its maximum brightness;

the determination unit is used for determining whether a first actual maximum luminous brightness that the light-emitting unit exhibits upon receipt of the primary maximum brightness driving signal is within a preset brightness range or not; and the threshold value setting unit is used for setting a preset threshold value in the register according to the first actual maximum luminous brightness and the preset brightness range such that a second actual maximum luminous brightness that the light-emitting unit exhibits upon receipt of a regulated maximum brightness driving signal whose duty ratio is equal to the preset threshold value is within the preset brightness range when it is determined by the determination unit that the first actual maximum luminous brightness is larger than a maximum value in the preset brightness range.

13. The regulation device for the backlight according to claim 12, wherein the threshold value setting unit is further used for setting the preset threshold value to 100% when it is determined by the determination unit that the first actual maximum luminous brightness is within the preset brightness range.

* * * * *